United States Patent [19]

Dixit

[11] Patent Number: 4,590,955

[45] Date of Patent: May 27, 1986

[54] CIGARETTE PAPER WITH REDUCED CO ON BURNING

[75] Inventor: Ajit S. Dixit, Brevard, N.C.

[73] Assignee: Olin Corporation, Pisgah Forest, N.C.

[21] Appl. No.: 629,804

[22] Filed: Jul. 11, 1984

[51] Int. Cl.[4] ..... A24B 15/18; A24D 1/02

[52] U.S. Cl. ..... 131/365; 131/358; 131/332; 131/334; 162/139; 162/158

[58] Field of Search ..... 131/332, 334, 365, 358; 162/158, 139

[56] References Cited

U.S. PATENT DOCUMENTS

| | | | |
|---|---|---|---|
| 3,046,994 | 7/1959 | Schur | 131/365 |
| 3,105,500 | 10/1963 | Wilson et al. | 131/334 |
| 3,310,060 | 3/1967 | Rickards et al. | 131/365 |
| 3,404,687 | 10/1968 | Rickards et al. | 131/365 |
| 4,108,151 | 8/1978 | Martin et al. | 131/365 |
| 4,146,041 | 3/1979 | Laszlo | 131/365 |
| 4,303,084 | 12/1981 | Simon | 131/365 |
| 4,433,697 | 2/1984 | Cline et al. | 131/365 |

FOREIGN PATENT DOCUMENTS

| | | | |
|---|---|---|---|
| 540019 | 4/1957 | Canada | 162/158 |
| 564275 | 10/1958 | Canada | 162/158 |
| 2456945 | 6/1975 | Fed. Rep. of Germany | 131/365 |

OTHER PUBLICATIONS

Tobacco Abstracts; (vol. 14; No. 10) Oct. 1970, Abstract No. 2520.

*Primary Examiner*—V. Millin

*Attorney, Agent, or Firm*—Kerkam, Stowell, Kondracki & Clarke

[57] ABSTRACT

The present invention relates to smoking article wrappers having a non-ionic surfactant added to the wrapper. The non-ionic surfactant is added to the wrapper in an amount sufficient to reduce the amount of carbon monoxide produced upon burning of the wrapper.

15 Claims, No Drawings

CIGARETTE PAPER WITH REDUCED CO ON BURNING

BACKGROUND OF INVENTION

1. Field of Invention

The present invention relates to cigarette papers and other cellulosic wrappers for smoking articles having reduced carbon monoxide emission on burning.

2. Prior Art

U.S. Pat. Nos. 3,046,994 and 3,404,687 disclose that a reduction in the "vapor phase constituents" of cigarette smoke can be attained by providing wrapper paper having a high degree of porosity.

U.S. Pat. No. 4,303,084 concerns a method for limiting the free burning time of a cigarette by coating the paper with a "polymeric chlorine-containing film-forming latex".

U.S. Pat. Nos. 4,108,151 and 4,433,697 disclose that "visible sidestream smoke" emanating from a cigarette during static burning may be reduced by incorporating in the wrapper paper gamma alumina filler and ceramic fibers in combination with magnesium oxide and/or hydroxide, respectively.

U.S. Pat. No. 4,146,041 teaches that the "gas phase constituents" on pyrolysis of cigarette paper stained brown with humic acid may be reduced by washing with water to reduce the water-soluble alkali metal salt content thereof.

U.S. Pat. No. 3,310,060 discloses incorporating a "poly(oxyethylene) compound in a cellulosic filter to absorb undesirable ingredients from cigarette smoke.

No effective method or means have been suggested heretofore, however, for reducing the amount of carbon monoxide formed by the burning of cigarette wrapper paper.

It is an object of the present invention to provide a cellulosic sheet material containing an additive which greatly reduces the amount of carbon monoxide emitted by the burning thereof.

It is a further object of the present invention to provide a wrapper for cigarettes and the like composed of the additive-containing paper.

It is a still further object of the present invention to provide a cigarette or similar smoking article wherein the wrapper comprises the additive-containing paper.

Finally, it is an object of the present invention to provide a method for the preparation of the cellulosic sheet material containing the CO emission reducing additive.

SUMMARY OF THE INVENTION

The foregoing and still further objects of the invention are achieved by providing a cellulosic sheet material containing an amount of a non-ionic surfactant sufficient to reduce the amount of carbon monoxide emitted upon burning the cellulosic sheet.

The present invention also provides a wrapper for enclosing tobacco or other smoking medium and a smoking article composed of the tobacco or smoking medium enclosed with the non-ionic surfactant containing cellulosic sheet wrapper.

The invention further provides methods for preparing the aforedescribed cellulosic sheet by (1) coating the sheet material with a solvent solution of the non-ionic surfactant followed by drying or (2) by application of the non-ionic surfactant to the cellulosic sheet by other methods, e.g., spraying.

DETAILED DESCRIPTION OF THE INVENTION

The exact mechanism by which the non-ionic surfactant functions to reduce carbon monoxide emission upon burning of paper in which it is incorporated is not fully understood. It is theorized that they stabilize the moisture content of the paper at a level incompatible with efficient carbon monoxide production on burning.

In any event, it has been found that any water-soluble non-ionic surfactant may be utilized in the practice of the invention. Preferred among such surfactants are the following:

(1) polymers having the formula:

$$H\left(OC\overset{R}{\overset{|}{H}}-CH_2\right)_n OH$$

wherein:

n is an integer from 3 to 60 and

R is H or $CH_3$ and wherein from 0 to 100% of the R groups in the polymer are H, or mixtures thereof;

(2) polymers having the formula:

$$R_1\left(O-C\overset{R}{\overset{|}{H}}-CH_2\right)_n OH$$

wherein:

n is an integer from 5 to 60;

R is H or $CH_3$, and wherein from 0 to 100% of the R groups in the polymer are H;

$R_1$ is a monovalent hydrocarbon radical consisting of alkyl and alkaryl containing 1 to 15 atoms; or mixtures thereof.

(3) polymers having the formula:

$$H\left(O-CH-CH_2\right)_n O-\left[(CH_2)_x-\overset{O\left(CH_2-\overset{R}{\overset{|}{C}}H-O\right)_n H}{\overset{|}{C}}-(CH_2)_y-O\right]_m-\left(CH_2-\overset{R}{\overset{|}{C}}H-O\right)_n H$$

wherein:

n is an integer from 5 to 60;

x is an integer from 5 to 30;

y is an integer from 5 to 30;

m is an integer from 5 to 20;

R is H or $CH_3$ and wherein from 0 to 100% of the R groups in the polymer are H, or mixtures thereof;

(4) polymers having the formula:

$$H-(OC_nH_{2n})_m OH$$

wherein:

n is an interger from 3 to 15; and m is an integer from 5 to 50.

In the above formula $R_1$ may be any monovalent alkyl or alkaryl group which does not deleteriously affect the surfactant properties of the molecule, e.g., octyl, nonylphenyl.

Most preferred among the non-ionic surfactants of the above formulae are:

(a) those produced by randomly condensing glycerol with ethylene oxide and propylene oxide and finally capping the hydroxyl ends thereof with ethylene oxide. (e.g., PG-2601, Olin Corp.):

(b) ethoxylated nonylphenol condensed with ethylene oxide. (e.g., Poly-Tergent B-300, Olin Corp.):

(c) those produced by condensing linear alcohols containing more than 10 carbon atoms, e.g., tridecyl alcohol, dodecyl alcohol, octyl phenol with ethylene oxide and, optimally, then with propylene oxide, i.e., PTS-405-LF, Olin Corp.; PTS-305-LF, Olin Corp.; PTLF-400, Olin Corp.; PTG-300, Olin Corp.;

(d) polyethylene glycols (e.g., Carbowax 2000, Union Carbide).

Any amount of non-ionic surfactant sufficient to reduce carbon monoxide emission during burning but insufficient to affect smoking enjoyment or the aesthetic appearance of the smoking article before, during or after burning may be incorporated in the paper. Generally, an amount of non-ionic surfactant in the range of from about 0.1% to about 10%, by weight, based on the weight of the paper, may be incorporated therein. The optimum amount will depend in each case, of course, upon the particular non-ionic surfactant and paper base selected.

The wrapper paper for enclosing tobacco or other smoking medium may be formed from the treated paper according to any conventional method and the wrapper papers may be utilized to enclose tobacco or any desired smoking medium according to conventional methods for preparing smoking articles.

The cellulosic fiber stock sheet or the wrapper papers prepared therefrom may be coated with a solvent (e.g., water or other aqueous medium) solution of the non-ionic surfactant, followed by drying. The most convenient method of coating comprises simply dipping the sheet or wrapper papers in a solution containing from about 0.1% to about 20%, by weight, of the non-ionic surfactant, followed by drying at room or an elevated temperature, i.e., from about 25° C. to about 140° C. Alternately, the cellulosic sheets may be sprayed with a solution of the surfactant and permitted to dry.

The invention is illustrated by the following non-limiting examples:

EXAMPLE 1

Ecusta's Reference 12566 cigarette paper was obtained in the form of 4" wide rolls. The paper was treated with the following (w/v) surfactant solutions and water (control) on a size press:

1. PG-2601—1.0%
2. PG-2601—2.5%
3. PG-2601—5.0%
4. Poly-Tergent B-200—2.5%.

Ecusta's Reference 12820 cigarette paper was obtained in the form of 4" wide rolls. The paper was treated with the following (w/v) surfactant solutions and water (control) on a size press:

5. PTS-405-LF
6. PTLF-400
7. PG-2601
8. PTS-305-LF
9. PTG-300.

Smoking analyses on the Phipps and Bird smoking machine were performed after rerolling the above cigarette papers onto Kentucky Referee 1R3 tobacco columns which were weight selected. The cigarettes were conditioned at 72° F. and 62% relative humidity prior to smoking. The results (TABLE 1) show a reduction in carbon monoxide yields ranging from 6% to 11% compared to that obtained from the control papers. Ash type and appearance ratings are based on the following scale:

1. Ash Appearance Rating ("A" Type)

| No. | Letter | Description |
|---|---|---|
| 95 | A | Small, perfect clinging flakes |
| 85 | B | Small, good, clinging flakes |
| 75 | C | Larger flakes, fair clinging flakes |
| 65 | D | Flakes show some tendency to cling |
| 55 | E | All paper ash falls off |

2. Ash Appearance on Highly Combustible Cigarette Paper (Nitrated or Citrated)

| Solidity - S | | Color - C | |
|---|---|---|---|
| No. | Description | No. | Description |
| 1 | Perfectly solid | 1 | White |
| 2 | | 2 | |
| 3 | Very solid | 3 | Gray White |
| 4 | | 4 | |
| 5 | Fairly solid | 5 | Gray |
| 6 | | 6 | |
| 7 | | 7 | |
| 8 | Large flakes | 8 | Dark gray |
| 9 | | 9 | |
| 10 | All paper ash falls off | 10 | Black |

TABLE 1

EFFECT OF SURFACTANTS ON CARBON MONOXIDE YIELDS

| Cigarette Paper Identification | Coresta Porosity | Count Per Cigarette | Carbon Monoxide (mg/cigarette) | Carbon Monoxide (mg/puff) | Static Burn Rate (mg/minute) | Ash Appearance | Percent Change Carbon Monoxide Per Cigarette | Dry Tar | Carbon Monoxide Tar |
|---|---|---|---|---|---|---|---|---|---|
| Reference 12556 - Control | 24 To 26 | 8.41 | 16.0 | 1.90 | 64.8 | S-5, C-4 | — | 27.91 | 0.573 |
| PG-2601 - 1.0% | 24 To 26 | 8.19 | 15.0 | 1.83 | 64.4 | S-5, C-4 | −6.25 | 27.21 | 0.551 |
| PG-2601 - 2.5% | 24 To 26 | 8.10 | 14.8 | 1.83 | 68.5 | S-5, C-4 | −7.50 | 25.91 | 0.571 |
| PG-2601 - 5% | 24 To 26 | 8.30 | 14.2 | 1.71 | 64.8 | S-6, C-5 | −11.40 | 24.81 | 0.572 |
| Poly-Tergent B-300 - 2.5% | 24 To 26 | 8.10 | 14.5 | 1.78 | 63.8 | S-5, C-5 | −9.50 | 24.61 | 0.590 |
| Reference 12820 - Control | 26 To 30 | 7.90 | 16.9 | 2.14 | 60.0 | 85-B | — | 26.61 | 0.635 |
| PTS-405-LF | 26 To 30 | 8.10 | 15.3 | 1.89 | 60.6 | 75-C | −9.50 | 25.31 | 0.604 |

TABLE 1-continued

EFFECT OF SURFACTANTS ON CARBON MONOXIDE YIELDS

| Cigarette Paper Identification | Coresta Porosity | Count Per Cigarette | Carbon Monoxide (mg/cigarette) | Carbon Monoxide (mg/puff) | Static Burn Rate (mg/minute) | Ash Appearance | Percent Change Carbon Monoxide Per Cigarette | Dry Tar | Carbon Monoxide Tar |
|---|---|---|---|---|---|---|---|---|---|
| PTLF-400 | 26 To 30 | 7.70 | 15.9 | 2.06 | 58.9 | 75-C | −5.90 | 27.61 | 0.576 |
| PG-2601 | 26 To 30 | 7.80 | 15.1 | 1.93 | 57.2 | 75-C | −10.30 | 25.71 | 0.587 |
| PTS-305-LF | 26 To 30 | 7.80 | 15.6 | 1.99 | 56.8 | 75-C | −7.40 | 35.61 | 0.438 |
| PTG-300 | 26 To 30 | 7.80 | 15.6 | 1.99 | 58.1 | 75-C | −7.70 | 25.91 | 0.602 |

The results in Table 1 also demonstrate that the amount of tar produced upon burning the treated papers was reduced.

EXAMPLE 2

Reference cigarette paper 1280 was obtained in 4" roll form. This untreated paper was used as a control. The following surfactant solutions were prepared in 2.5% concentration by weight; in water: PTS 405 LF, PTLF 400, PG 2601, PTS 305 LF and PTG 300.

The 12820 paper was cut in 4×15" strips. The felt side, marked with a pencil, were dipped by hand in pans containing each of the five solutions. The paper was passed on a size press at 40 PSi and dried at 250° F. The papers were cut in strips and measured for porosity (Coresta). The porosity of each paper was matched in the range 28–30 Coresta. Three sets of control cigarettes (a total of 9) were rerolled using Kentucky Referee 1R3 tobacco columns weighing 0.90–0.92 grams. Similarly, three sets of test cigarettes were rerolled using Kentucky Referee 1R3 tobacco columns weighing 0.90–0.92 grams. The cigarettes were conditioned at 72° F. and 62% RH for 48 hours.

For the static burn rate (SBR) studies one set each (containing 3) of each kind of paper were rerolled into cigarettes using Kentucky Referee 1R3 tobacco columns weighing 0.88–0.89 grams.

The P and B smoking machine was calibrated and a smoking run was made. The results of smoke yielded and SBR are shown in Tables 2 and 3.

$$SBR = \frac{wby\ \text{tobacco (cigarette)} \times 0.671}{\text{time (min.)}} \left[0.671 = \frac{47\ \text{mm}}{70\ \text{mm}}\right].$$

TABLE 2

| Surfactant Type | Weight of Cigarettes | Burn Rate Min. | SBR Average | Ash Type | Remarks |
|---|---|---|---|---|---|
| 12820 Control | 0.88, 0.885 0.875 | 10.00, 10.0 9.5 | 59.2, 59 , 61.8 60 | 85B | Small to large good clinging |
| PTG 300 | 0.855, 0.895 0.90 | 10.75, 9.75 10.5 | 55.2, 57.2, 61.9 58.1 | 75C | large flakes fair clinging |
| PG 2601 | 0.90, 0.89 0.895 | 10.1, 10.5 10.75 | 56.2, 58.3, 57.2 57.2 | 75C | large flakes fair clinging |
| PTLF 400 | 0.87, 0.87 0.87 | 9.75, 10.10 | 58.4, 59.9, 58.4 58.9 | | |
| PTS 305 LF | 0.88, 0.89 0.89 | 9.75, 10.75 11.0 | 60.6, 55.5, 54.3 56.8 | 75C | large flakes fair clinging |
| PTS 405 LF | 0.875, 0.88 0.88 | 10, 9.75, 9.5 | 58.7, 60.1, 62.2 60.6 | 75C | large flakes, fair clinging, more solid |

TABLE 3

SMOKE YIELDS - AVERAGE VALUES

| Surfactant Type | Puff count per cigarette | Carbon Monoxide mg/cig | CO mg/puff | Ave. wet tar (dry tar) mg/cig. | % change CO mg/cig | % change wet tar mg/cig. |
|---|---|---|---|---|---|---|
| 12820 Control | 7.9 | 16.9 | 2.14 | 33.2 (26.61) | — | — |
| PTS 405 LF | 8.07 | 15.29 | 1.89 | 31.9 (25.31) | −9.5 | −3.9 |
| PTLF 400 | 7.73 | 15.9 | 2.06 | 34.2 (27.61) | −5.9 | +2.9 |
| PG 2601 | 7.85 | 15.1 | 1.93 | 32.3 (25.71) | −10.3 | −2.7 |
| PTS 305 LF | 7.84 | 15.6 | 1.99 | 42.2 (35.61) | −7.4 | +27 |
| PTG 300 | 7.84 | 15.6 | 1.99 | 32.5 (25.91) | −7.7 | −2.1 |

EXAMPLE 3

This example demonstrates the effect of the concentration of ionic surfactant in the paper on carbon monoxide yield on burning.

Reference 12556 cigarette paper was obtained in the form of 4" rolls. Untreated paper was used as a control. The following concentrations (w/v) of PG 2601 were prepared in water. Also Poly-Tergent B-300 was used in 2.5% concentration PG 2601, 1, 2.5% and 5% concentration solutions.

The reference 12556 paper was hand-dipped in each of the solutions, size pressed and dried at 250° F. The porosities of the paper were matched between 24–26 Coresta. Three sets of control cigarettes, three per set (a total of 9) were rerolled using Kentucky Referee 1R3 tobacco columns, weighing 0.90 and 0.91 grams. Similarly, three sets of test cigarettes were rerolled using Kentucky Referee 1R3 tobacco columns weighing 0.90 and 0.91 grams. The cigarettes were conditioned at 72° F. and 62% R.H. for 24 hours. For the static burn rate studies, one set each (containing 3) of each kind of paper were rerolled into cigarettes using Kentucky Referee 1R3 tobacco columns weighing 0.88, 0.89 grams.

The P and B smoking machine was calibrated and a smoking run was made. The results of smoke yields and SBR are shown in Tables 4 and 5.

TABLE 4

| Surfactant Type | Weight of Cigarettes | SBR Burn Rate Min. | SBR Average | Ash Type | Remarks |
|---|---|---|---|---|---|
| 12556 Control | 0.935, 0.945 0.93 | 9.83, 9.5, 9.75 | 64.8 | C-4 Bet. S4 + S5 | Better than fairly solid |
| PG 2601 1% | 0.93, 0.935 0.94 | 9.5, 9.5, 10.25 | 64.4 | S-4 C4 S-5 | Better than fairly solid |
| PG 2601 2.5% | 0.92, 0.935 0.93 | 9.25, 9.25, 8.75 | 68.5 | S4 C4 S5 | Better than fairly solid |
| PG 2601 5% | 0.94, 0.94 0.92 | 10, 9.5, 9.5 | 64.8 | S6-C5 | Better than fairly solid |
| Poly-TB-300 (2.5%) | 0.925, 0.945 0.93 | 9.25, 10.5, 9.66 | 63.8 | C5-C5 | Better than fairly solid |

TABLE 5

| Surfactant Type | Puff count per cig. | SMOKE YIELDS (Average) CO mg/cig. | CO mg/puff | Wet tar (dry tar) mg/cig. | % change CO/cig. | % change wet tar per cig. | $CO_2$ mg/cig. |
|---|---|---|---|---|---|---|---|
| 12556 Control | 8.41 | 16.0 | 1.9 | 34.5 (27.91) | — | — | 41.1 |
| 1% PG 2601 | 8.19 | 15.0 | 1.83 | 33.8 (27.21) | −6.25 | −2.0 | 40.07 |
| 2.5% PG 2601 | 8.1 | 14.8 | 1.83 | 32.5 (25.91) | −7.5 | −5.79 | 39.7 |
| 5% PG 2601 | 8.3 | 14.2 | 1.71 | 31.4 (24.81) | −11.4 | −8.9 | 39.97 |
| 2.5% Poly-TB 300 | 8.1 | 14.5 | 1.78 | 31.2 (24.61) | −9.5 | −9.6 | 39.1 |

EXAMPLE 4

Reference 12820 cigarette paper was obtained in the form of 4" wide rolls. This untreated paper was used as a control. The following waxes were prepared:

| Wax | Type | Concentration (Grams per 100 Milliliters) | Solvent |
|---|---|---|---|
| | Water Insoluble Waxes | | |
| Candelilla | Vegetable | 2.5 | Toluene |
| Carnauba | Vegetable | 2.5 | Toluene |
| Paraffin | Petroleum | 2.5 | Toluene |
| | Water Soluble Surfactants | | |

-continued

| Wax | Type | Concentration (Grams per 100 Milliliters) | Solvent |
|---|---|---|---|
| Carbowax | Union Carbide | 2.51 | Water |
| Poly-Tergent B-300 | Olin | 2.47 | Water |

The solutions were applied by hand-dipping the cigarette paper in respective solutions and passed through a size press at 40 pounds per square inch and dried at 250° F. The porosity of each paper was matched in the range of 26 to 29 Coresta. Three sets of control cigarettes (three per set), for a total of nine, were rerolled using Kentucky Referee 1R3 tobacco columns weighing 0.87 grams, 0.88 grams, and 0.90 grams. Similarly, three sets of test cigarettes (three per set) for each type of wax were rerolled using Kentucky Referee 1R3 tobacco columns weighing 0.87 grams, 0.88 grams, and 0.90 grams. An extra control using two sets of toluene dipped cigarette paper was also using in the experiment.

For the static burn rate studies, three cigarettes were rerolled using Kentucky Referee 1R3 tobacco columns weighing 0.91 grams to 0.93 grams for each type of coated paper and controls. The cigarettes were conditioned at 72° F. and 62% relative humidity for 48 hours. The Phipps and Bird smoking machine was calibrated and the smoking run was made. The results are shown in Tables 6 and 7.

The example indicates a 13.7% reduction in carbon monoxide yields for Poly-Tergent B-300 and a 10.9% reduction in wet tar yields. For Carbowax 2000 it indicates a 4.9% reduction in carbon monoxide yields and a 4.8% reduction in wet tar yields. For water insoluble waxes no reduction is carbon monoxide or wet tar yields was found.

TABLE 6

| Wax Type | Weight (Grams) | STATIC BURN RATE Burn Rate | Average Static Burn Rate | Ash Appearance |
|---|---|---|---|---|
| Toluene Dipped - No wax | 0.93 | 10 minutes and 50 seconds | 57.4 | S-5, C-5 |
| | 0.93 | 11 minutes | | |
| | 0.93 | 10 minutes and 45 second | | |
| Reference 12820 Control | 0.905 | 11 minutes | 55.2 | S-5, C-5 |
| | 0.90 | 10 minutes and 45 seconds | | |
| | 0.87 | 10 minutes and 45 seconds | | |
| Carbowax 2000 | 0.92 | 10 minutes and 45 seconds | 59.2 | S-5, C-5 |
| | 0.91 | 9 minutes and 40 seconds | | |
| | 0.93 | 10 minutes and 55 seconds | | |
| Candelilla | 0.91 | 10 minutes and 15 seconds | 57.1 | S-5, C-5 |
| | 0.91 | 10 minutes and 45 seconds | | |
| | 0.92 | 11 minutes and 15 seconds | | |
| Carnauba | 0.93 | 11 minutes and 15 seconds | 55.7 | 80 |
| | 0.93 | 11 minutes | | |
| | 0.92 | 11 minutes and 15 seconds | | |
| Paraffin | 0.91 | 10 minutes and 15 seconds | 60.7 | 80 |
| | 0.93 | 10 minutes | | |
| | 0.92 | 10 minutes and 15 seconds | | |
| Poly-Tergent B-300 | 0.92 | 10 minutes | 60.8 | 80 |
| | 0.92 | 9 minutes and 45 seconds | | |
| | 0.915 | 10 minutes and 40 seconds | | |

TABLE 7

| Wax Type | Average Puff Count Per Cigarette | CARBON MONOXIDE AND WET TAR YIELDS Average Carbon Monoxide (mg/cigarette) | Average Carbon Monoxide (mg/puff) | Average Wet Tar (mg/cigarette) | % Change Carbon Monoxide Per Cigarette | % Change Wet Tar Per Cigarette |
|---|---|---|---|---|---|---|
| Reference 12820 Control | 8.3 | 15.5 | 1.8 | 33.0 | — | — |
| Toluene Dipped - No Wax | 7.8 | 15.7 | 2.0 | 30.5 | +1.4 | −7.5 |
| Candelilla | 8.1 | 16.1 | 1.9 | 34.8 | +4.1 | +5.5 |
| Carnauba | 8.1 | 16.9 | 2.1 | 33.9 | +9.4 | +2.7 |
| Carbowax 2000 | 7.9 | 14.7 | 1.9 | 31.4 | −4.9 | −4.8 |
| Paraffin | 7.9 | 16.3 | 2.0 | 33.1 | +5.5 | +0.3 |
| Poly-Tergent B-300 | 7.9 | 13.3 | 1.7 | 29.4 | −13.7 | −10.9 |

EXAMPLE 5

Reference 12820 cigarette paper was obtained in the form of 4" wide rolls. Untreated paper was used as a control. The following surfactants prepared by dissolving 2.5 grams of each surfactant in 100 milliliters of water were prepared.

1. PTS-405-LF
2. PTLF-400
3. PG-2601
4. PTS-305-LF
5. PTG-300.

The surfactants were applied by hand dipping the cigarette paper in respective solutions and passed through a size press at 40 pounds per square inch and dried at 250° F. The porosity of each paper was matched in the range of 26 to 30 Coresta. Three sets of control cigarettes (three per set), for a total of nine, were rerolled using Kentucky Referee IR3 tobacco columns weighing 0.90 to 0.92 grams. Similarly, three sets of test cigarettes (three per set) for each type of surfactant were rerolled using Kentucky Referee 1R3 tobacco columns weighing 0.90 to 0.92 grams.

For the static burn rate studies, three cigarettes were rerolled using Kentucky Referee 1R3 tobacco columns weighing 0.88 grams and 0.89 grams for each type of surfactant and control. The cigarettes were conditioned at 72° F. and 62% relative humidity for 24 hours. The Phipps and Bird smoking machine was calibrated and the smoking run was made. The results are shown in Tables 8 and 9.

The experiment indicates an overall reduction of carbon monoxide with all the surfactants used. The greatest decrease in carbon monoxide yields was obtained with PG-2601 (10.3% reduction).

TABLE 8

| Surfactant Type | STATIC BURN RATE Average Static Burn Rate (mg/minutes) | Ash Appearance |
|---|---|---|
| Reference 12820 (Control) | 60.0 | 85-B |
| PTS-405-LF | 60.6 | 75-C |
| PTLF-400 | 58.9 | 75-C |
| PG-2601 | 57.2 | 75-C |
| PTS-305-LF | 56.8 | 75-C |
| PTG-300 | 58.1 | 75-C |

TABLE 9

| Wax Type | Average Puff Count Per Cigarette | Average Carbon Monoxide (mg/cigarette) | Average Carbon Monoxide (mg/puff) | Average Wet Tar (mg/cigarette) | % Change Carbon Monoxide Per Cigarette | % Change Wet Tar Per Cigarette |
|---|---|---|---|---|---|---|
| | | CARBON MONOXIDE AND WET TAR YIELDS | | | | |
| Reference 12820 (Control) | 7.9 | 16.9 | 2.14 | 33.2 | — | — |
| PTS-405-LF | 8.1 | 15.3 | 1.89 | 31.9 | −9.5 | −3.9 |
| PTLF-400 | 7.7 | 15.9 | 2.06 | 34.2 | −5.9 | +2.9 |
| PG-2601 | 7.8 | 15.1 | 1.93 | 32.3 | −10.3 | −2.7 |
| PTS-305-LF | 7.8 | 15.6 | 1.99 | 42.2 | −7.4 | +27.0 |
| PTG-300 | 7.8 | 15.6 | 1.99 | 32.5 | −7.7 | −2.1 |

EXAMPLE 6

TABLE 10

| Surfactant | Average Puff Count Per Cigarette | Average Carbon Monoxide (mg/cigarette) | Average Carbon Monoxide (mg/puff) | Average Wet Tar (mg/cigarette) | Average % Change Monoxide per Cigarette | Average % Change Wet Tar per Cigarette | Average Static Burn Rate mg/minute | Average Ash Appearance |
|---|---|---|---|---|---|---|---|---|
| Reference 12556 Control | 8.41 | 16.0 | 1.90 | 34.5 | — | — | 64.8 | S-5, C-4 |
| PG-2601 - 1% | 8.19 | 15.0 | 1.83 | 33.8 | −6.25 | −2.0 | 64.4 | S-5, C-4 |
| PG-2601 - 2.5% | 8.10 | 14.8 | 1.83 | 32.5 | −7.50 | −5.8 | 68.5 | S-5, C-4 |
| PG-2601 - 5% | 8.30 | 14.2 | 1.71 | 31.4 | −11.40 | −8.9 | 64.8 | S-6, C-5 |
| Poly-Tergent B-300 - 2.5% | 8.10 | 14.5 | 1.78 | 31.2 | −9.50 | −9.6 | 63.8 | S-5, C-5 |

Reference 12556 cigarette paper was obtained in the form of 4" wide rolls. Untreated paper was used as a control. The following surfactant solutions (w/v) were prepared. The solutions were prepared in water.

1. PG-2601—1%
2. PG-2601—2.5%
3. PG-2601—5%
4. Poly-Tergent B-300—2.5%.

The surfactants were applied by hand dipping the cigarette paper in the respective solutions and passed through a size press at 40 pounds per square inch and dried at 250° F. The porosity of each paper was matched in the range of 24 to 26 Coresta. Three sets of control cigarettes (three per set), for a total of nine, were rerolled using Kentucky Referee 1R3 tobacco columns weighing 0.89 grams to 0.90 grams. Similarly, three sets of test cigarettes (three per set) for each concentration level of the surfactant were rerolled using Kentucky Referee 1R3 tobacco columns weighing 0.89 grams to 0.90 grams.

For the static burn rate studies, three cigarettes were rerolled using Kentucky Referee 1R3 tobacco columns weighing 0.88 grams and 0.89 grams for each of the surfactant solutions. The cigarettes were conditioned at 72° F. and 64% relative humidity for 24 hours. The Phipps and Bird smoking machine was calibrated and the smoking run was made. The results are shown in Table 10.

This study indicated an overall reduction of carbon monoxide and wet tar yields for each of the surfactant solutions. The carbon monoxide yields decreased to a maximum of 11.4% for a 5% PG-2601 applied cigarette paper and the wet tar decreased by 8.9% for the same cigarette paper.

I claim:

1. Smoking article wrapper comprising a cellulosic sheet containing an amount of a non-ionic surfactant sufficient to reduce the amount of carbon monoxide produced upon burning said cellulosic sheet.

2. The smoking article wrapper of claim 1 wherein said non-ionic surfactant is selected from the group consisting of polymers having the formula:

$$H\left(OC\overset{R}{\overset{|}{H}}-CH_2\right)_n OH$$

wherein:

n is an integer from 3 to 60; and

R is H or $CH_3$, and wherein from 0 to 100% of the R groups in the polymer are H, or mixtures thereof.

3. The smoking article wrapper of claim 1 wherein said non-ionic surfactant is selected from the group consisting of polymers having the formula:

$$R_1\left(O-\overset{R}{\overset{|}{C}}H-CH_2\right)_n OH$$

wherein:

n is an integer from 5 to 60;

R is H or $CH_3$, and wherein from 0 to 100% of the R groups in the polymer are H;

$R_1$ is a monovalent hydrocarbon radical consisting of alkyl and alkaryl containing 1 to 15 atoms; or mixtures thereof.

4. The smoking article wrapper of claim 1 wherein said non-ionic surfactant is selected from the group consisting of polymers having the formula:

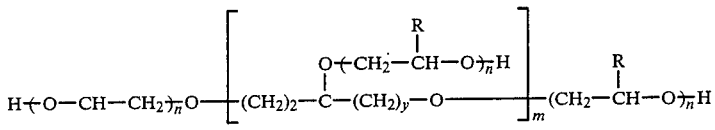

wherein:

n is an integer from 5 to 60;

x is an integer from 5 to 30;

y is an integer from 5 to 30;

m is an integer from 5 to 20;

R is H or $CH_3$, and wherein from 0 to 100% of the R groups in the polymer are H, or mixtures thereof.

5. The smoking article wrapper of claim 1 wherein said non-ionic surfactant is selected from the group consisting of polymers having the formula:

$$H-(OC_nH_{2n})_mOH$$

wherein:

n is an integer from 3 to 15; and m is an integer from 5 to 50.

6. The smoking article wrapper of claim 3 wherein said monovalent hydrocarbon radical is nonylphenyl.

7. The smoking article wrapper of claim 3 wherein said monovalent hydrocarbon radical is linear tridecyl.

8. The smoking article wrapper of claim 3 wherein said monovalent hydrocarbon radical is dodecyl.

9. The smoking article wrapper of claim 3 wherein said monovalent hydrocarbon radical is octylphenyl.

10. The smoking article wrapper of claim 1 wherein said non-ionic surfactant is polyethylene glycol.

11. The smoking article wrapper of claim 1 containing from about 0.1 to about 10%, by weight, of said non-ionic surfactant.

12. A smoking article wrapper for enclosing tobacco or smoking medium to form a smoking article composed of the paper of claim 1.

13. The smoking article wrapper of claim 12 comprising a cigarette paper.

14. A smoking article comprising a tobacco or smoking medium charge and a wrapper therefor, said wrapper comprising that of claim 13.

15. The smoking article of claim 14 comprising a cigarette.

* * * * *